US005490608A

United States Patent [19]

Hawkins

[11] Patent Number: 5,490,608

[45] Date of Patent: Feb. 13, 1996

[54] MULTIPLE DETERGENT CONTAINER

[76] Inventor: Quentin P. Hawkins, 2450 Weston Rd., Apt. 1005, Toronto, Ontario, Canada, M9N 2A3

[21] Appl. No.: 265,023

[22] Filed: Jun. 24, 1994

[51] Int. Cl.[6] ..... B65D 90/04

[52] U.S. Cl. ..... 220/524; 220/527; 220/553; 220/555; 220/601; 220/500

[58] Field of Search ..... 220/524, 527, 220/553, 555, 601, 550

[56] References Cited

U.S. PATENT DOCUMENTS

| | | | |
|---|---|---|---|
| 815,783 | 3/1906 | Becherer | 220/524 |
| 2,665,816 | 1/1954 | Anft | 220/524 |
| 2,826,338 | 3/1958 | Davis | 220/524 |
| 4,993,584 | 2/1991 | Macario | 220/524 |
| 5,111,958 | 5/1992 | Witthoeft | 220/524 |
| 5,150,794 | 9/1992 | Rooks | 220/524 |

*Primary Examiner*—Joseph M. Moy
*Attorney, Agent, or Firm*—Eugene J. A. Gierczak

[57] ABSTRACT

In a portable container having a receptacle adapted to receive liquid, the receptacle having an opening on the upper surface of the container for both receiving and discharging liquid. In the preferred embodiment, the portable container also has a second set of receptacles adapted to receive powders, each receptacle extending between the upper and lower surfaces of the container, having an opening on the lower surface for receiving the powders and an opening on the upper surface for discharging the powders.

15 Claims, 4 Drawing Sheets

MULTIPLE DETERGENT CONTAINER

FIELD OF INVENTION

This invention relates to a novel portable container having multiple compartments for receiving, containing and dispensing powders and liquids used for the care of washable items.

BACKGROUND OF THE INVENTION

Various containers have heretofore been designed to contain a variety of substances.

It is not unusual for individuals who live in apartments or who do not own their own washing machine to carry a number of containers such as liquid bleach and powdered detergents to a coin washing location. At the location, various loads of washing usually require multiple measuring of detergent or other substances used for the care of washable items.

It is an object of this invention to provide an improved container with multiple compartments to receive, contain and dispense a variety of liquids and powders used in the care of washable items, which is convenient, easy to use and easily transportable.

It is another aspect of this invention to provide an improved container for powders with multiple compartments of equal volume, such that the user may easily dispense known volumes of powders into the container and may conveniently dispense these substances from the container.

It is another aspect of this invention to provide for a container having an elongated compartment for containing liquid, having one opening on such compartment for both receiving and dispensing the liquid, and a second set of elongated compartments for containing powders, each of the second set of compartments having an opening at one end of the compartment for discharging powder and a larger opening at the other end of the compartment for receiving powder. The larger opening for receiving powder and the smaller opening for discharging powder improves the ease of filling each compartment with powder and of dispensing such powder from each compartment.

It is another aspect of this invention to provide for a novel container for multiple liquids and powders designed with small openings for the discharge of such powders and liquids so as to reduce spillage of such substances.

It is an object of this invention to provide an improved container with multiple compartments comprising of translucent material, in order that the user may readily observe the volumes of substances contained within each compartment and thus also the volume of substances introduced into each compartment or dispensed from each compartment.

It is another aspect of this invention to provide for a container having multiple compartments to contain liquids and powders used in the care of washable items which is easy to transport and relieves the user from transporting multiple individual containers of substances.

DESCRIPTION OF THE DRAWINGS

These and other objects and features of the invention shall now be described in relation to the following drawings which illustrate the preferred embodiment of the invention.

DESCRIPTION OF THE INVENTION

Like parts shall be given like numbers throughout the figures.

Figure 1:
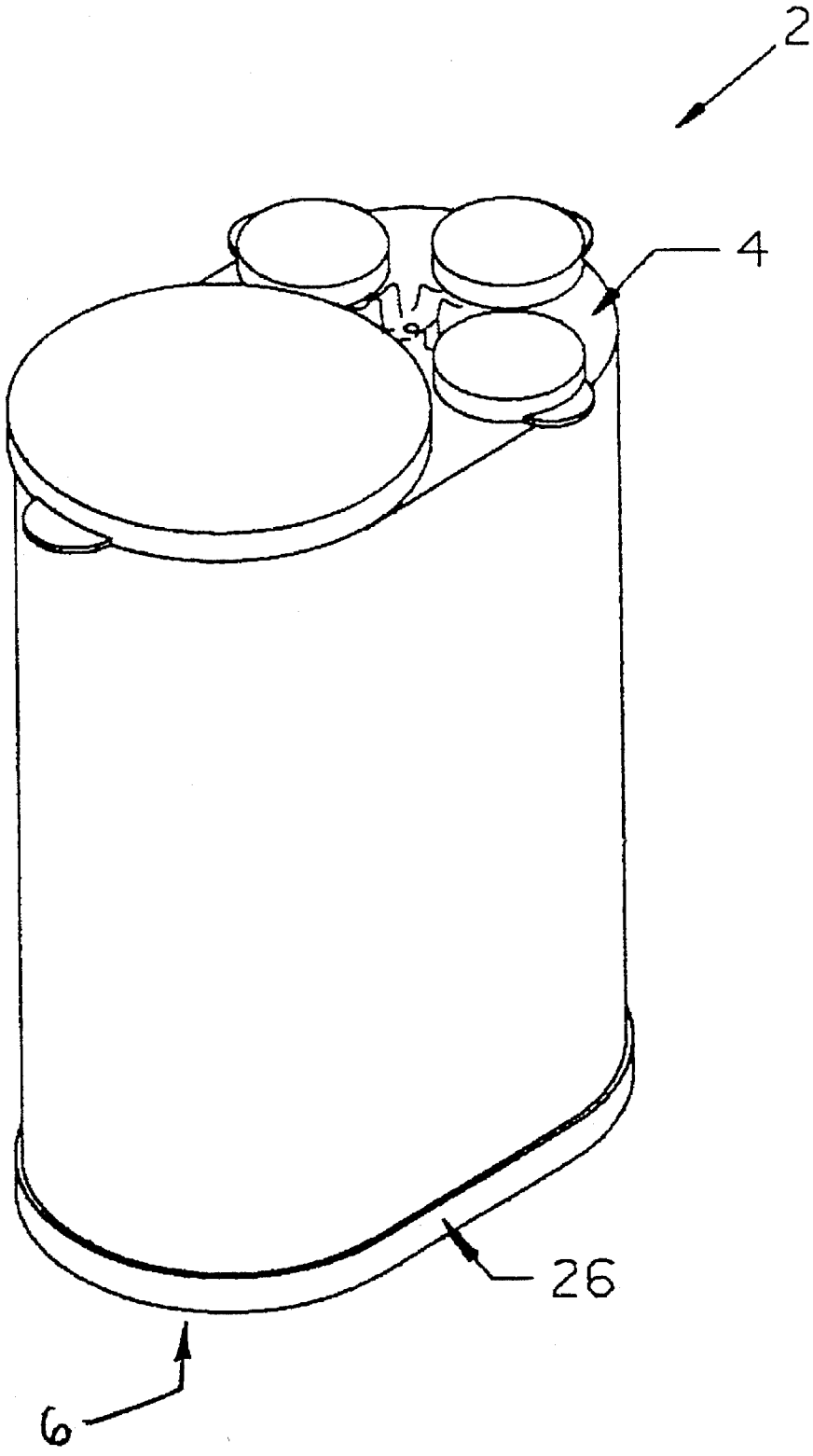
FIG. 1 is a front perspective view of the portable container.
Figure 2:
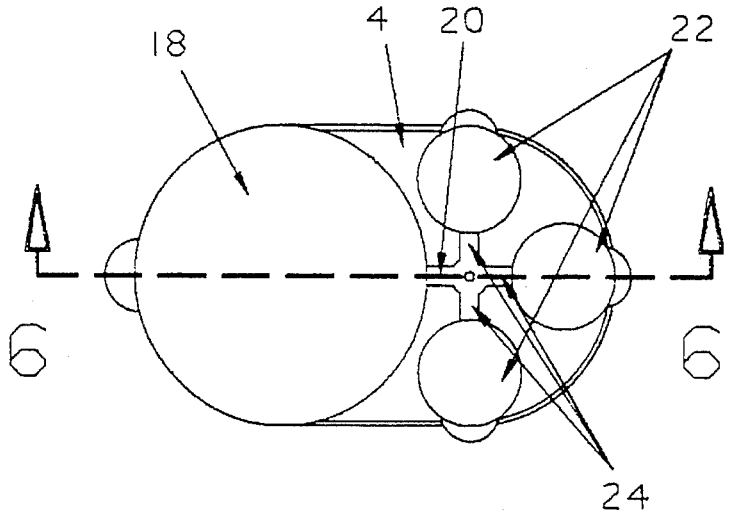
FIG. 2 is a top view of the portable container.
Figure 3:
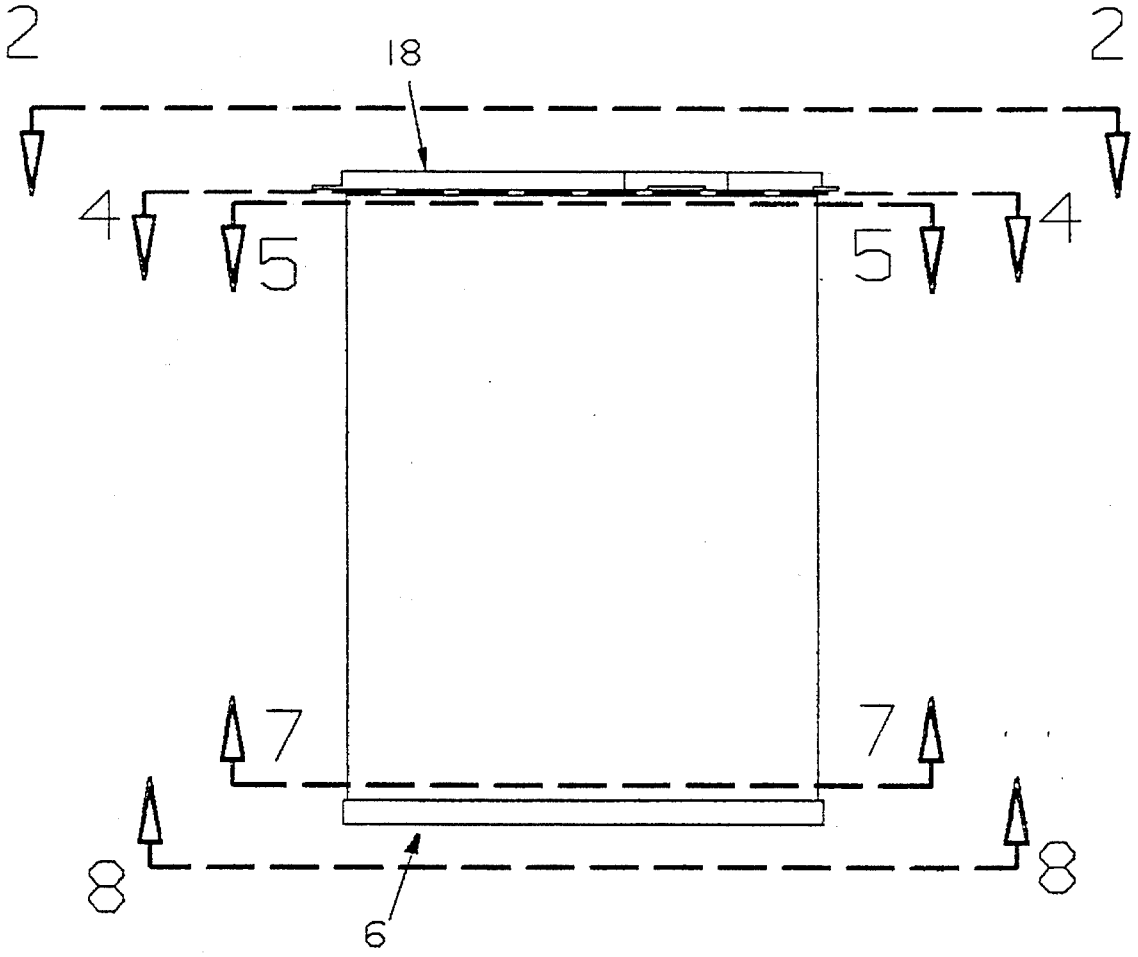
FIG. 3 is a side view of the portable container.
Figure 4:
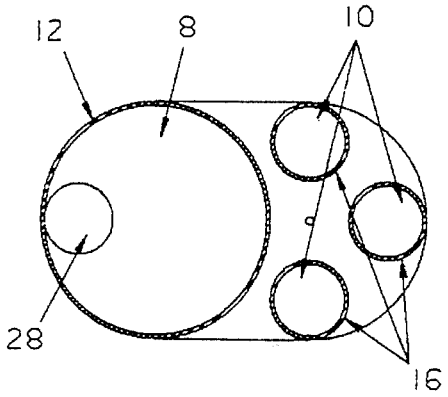
FIG. 4 is a cross-sectional view of the portable container along the line 4—4 of FIG. 3.

FIG. 1 illustrates the portable container 2 having an upper surface 4 and a lower planar surface 6.

In the preferred embodiment, the portable container 2 has a first receptacle 8 for containing liquid and a second set of receptacles 10 for containing powders.

The receptacle 8 has an opening 12 on upper surface 4 for receiving and discharging liquid. Each receptacle of the second set of receptacles 10 has an opening 14 for receiving the powders on the lower planar surface 6 and an opening 16 on the upper surface 4 for discharging the powders.

The opening 12 has a cover 18 for releasably covering the opening 12 and containing any liquid that has been dispensed through opening 12 and is contained within receptacle 8.

In the preferred embodiment, cover 18 is a snap cover, which is permanently attached to the upper surface 4 by retaining strap 20.

Each of the openings 16 has a cover 22 for releasably covering the openings 16 and containing powders within receptacles 10. In the preferred embodiment, the covers 22 are snap covers, which are each permanently attached to the upper surface 4 by retaining straps 24.

A cover 26 releasably covers openings 14 on lower planar surface 6, and contains any powders, within receptacle 10. In the preferred embodiment, the cover 26 is a snap cover.

Figure 6:
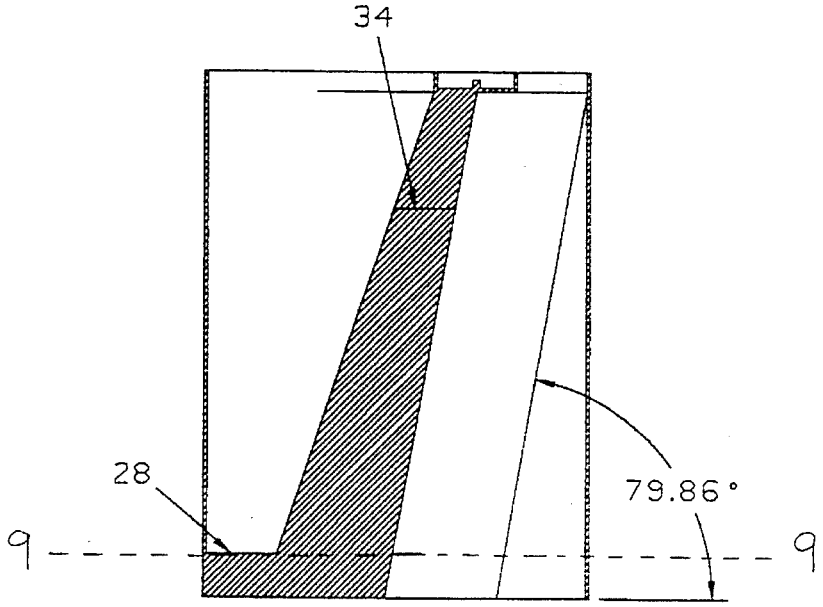
FIG. 6 is a cross-sectional view of the portable container along the line 6—6 of FIG. 2.

In the preferred embodiment, receptacle 8 is elongated and cone shaped, extending from opening 12 to a planar surface 28 and does not extend to lower planar surface 6. Opening 12 is circular in cross-section. Receptacles 10 are elongated, extending from openings 16 to lower planar surface 6. When each of receptacles 10 is filled with a substance to the line 9—9 on FIG. 6, the substances in each of receptacles 10 are of equal volume. Openings 16 are circular in cross-section, and each opening 16 is of a smaller radius than opening 12. However, in other embodiments, the receptacles may be of a different shape and volume and the openings may be of a different shape and size in relation to one another.

The container 2 may be comprised of a variety of materials, but in the preferred embodiment is comprised of a translucent material in order that the substances contained within may be viewed.

Figure 5:
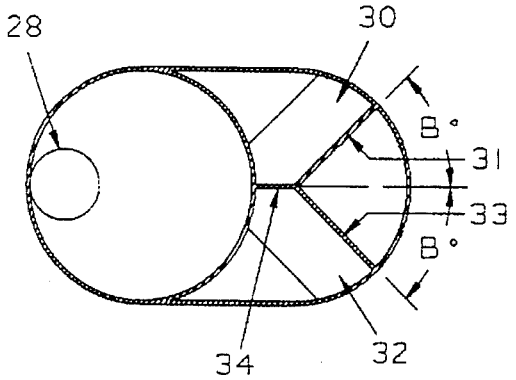
FIG. 5 is a cross-sectional view of the portable container along the line 5—5 of FIG. 3.

FIG. 5 illustrates that the receptacles 10 are separated from one another by a webbed surface 30, 32 and 34. The webbed surface 34 is generally disposed at a perpendicular angle to the bottom as best seen in FIG. 5. However, webbed surface 30 is disposed at an acute angle (a) to the generally lower planar surface. Moreover, web 32 is also disposed at an acute angle (a). In the preferred embodiment the angle (a) can be 79.86 degrees. The angled nature of the webs 30 and 32 assist in directing or converging powder materials within such receptacles 10 towards the opening 16. This is best illustrated in FIG. 7.

Figure 7:
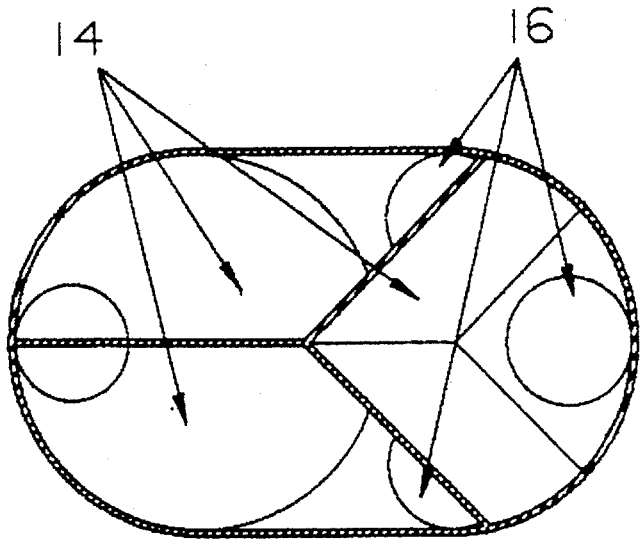
FIG. 7 is a cross-sectional view of the portable container along the line 7—7 of FIG. 3.
Figure 8:
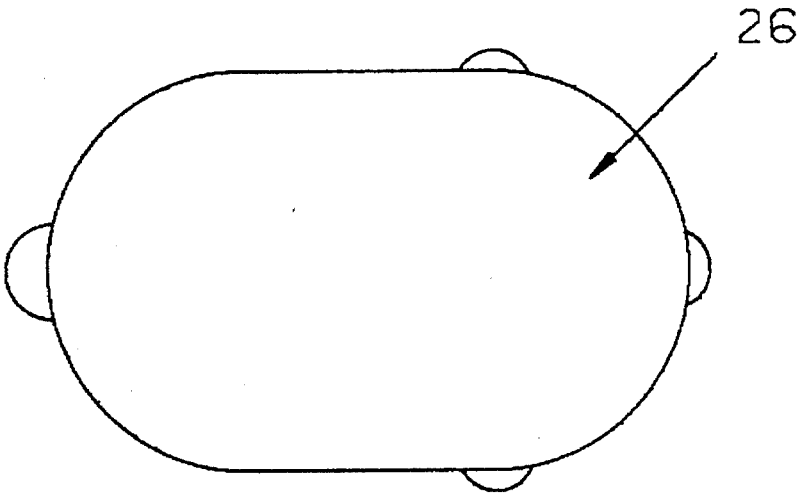
FIG. 8 is a bottom view of the portable container.

Moreover, two of the receptacles 10 which border on the web 34 are angled so that they extend below the receptacle 8 as best illustrated in FIG. 7.

Furthermore, the top edge 31 of web 30 is disposed at an acute angle (b) as best seen in FIG. 5. The top edge 33 of web 32 is also disposed at the same angle (b) which in the preferred embodiment is 45 degrees.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A portable container having:

(a) an upper surface;

(b) a lower surface;

(c) a first receptacle for containing a first substance said first receptacle having a first receptacle opening on said upper surface for receiving and discharging said first substance said first receptacle having a conical surface extending downwards from said first receptacle opening from said upper surface to a planar marker surface disposed between said upper surface and said lower planar surface;

(d) a plurality of second receptacles disposed between said upper and lower surfaces for containing a second substance each said second receptacles adapted to receive said second substance, each of said plurality of said second receptacles:

(i) extending between said upper and lower surface;

(ii) having an opening on said lower surface for receiving said powder; and (iii) an opening on said upper surface for discharging said powder wherein each of said second receptacles are of substantially equal volume when filled with powder to said planar marker surface.

2. A portable container as in claim 1 having a cap means for releasably covering said opening on said lower planar surface for said second receptacles.

3. A portable container as in claim 2 having a plurality of cap means for releasably covering said openings on said upper surface of said plurality of second receptacles respectively.

4. A portable container as in claim 3 wherein said cap means are snap closures for sealing said openings.

5. A portable container as in claim 4 wherein said openings of each of said second receptacles on said upper surface have a circular cross-section.

6. A portable container as in claim 5 wherein said portable container is of oval cross-section.

7. A portable container as in claim 6 wherein each of said plurality of second said receptacles are elongated.

8. A portable container as in claim 7 wherein said container is of translucent material in order that said substances may be viewed.

9. A portable container having:

(a) a lower surface;

(b) an upper surface;

(c) a first receptacle for receiving a liquid said first receptacle having one opening on said upper surface for both receiving and discharging said liquid said first receptacle having a conical surface extending downwardly from said upper surface to a planar marker surface disposed between said upper surface and said lower planar surface;

(d) a plurality of second receptacles disposed between said Upper and lower surfaces, each said second receptacles for receiving powder, each of said second receptacles (i) extending between said upper and lower surfaces in a linear direction;

(ii) having an opening on said lower planar surface for receiving said powder, and (iii) an opening on said upper surface for discharging said powder;

wherein each of said second receptacles are of substantially equal volume when filled with powder to said planar marker surface.

10. A portable container as in claim 9 having a plurality of cap means for releasably covering each of said openings on said upper surface.

11. A portable container as in claim 10 having a cap means for releasably covering said lower surface to contain said powders in said second receptacles.

12. A portable container as in claim 11 wherein said second receptacles extend below said first receptacle to said lower surface.

13. A portable container as in claim 12 wherein said openings to each of said second receptacles on said upper surface are circular in cross-section and of similar size.

14. A portable container as in claim 13 wherein said portable container is of oval cross-section and said plurality of second receptacles comprise three of said second receptacles defined by a webbed surface disposed substantially perpendicular to said lower surface and a pair of webbed surfaces converging with said substantially perpendicular webbed surfaces disposed at an acute angle to said lower surface, whereby each of said second receptacles are of substantially equal volume when filled with powder to said planar marker surface.

15. A portable container as in claim 14 wherein said acute angle is 79.86 degrees.

* * * * *